United States Patent [19]

Nagano

[11] Patent Number: 4,732,167

[45] Date of Patent: Mar. 22, 1988

[54] SMOKING AID FOR REDUCING CONCENTRATIONS OF POISONOUS SUBSTANCES CONTAINED IN TOBACCO SMOKE

[76] Inventor: Hideo Nagano, 13-5, Shimomeguro 5-Chome, Meguro-Ku, Tokyo, Japan

[21] Appl. No.: 890,465

[22] Filed: Jul. 29, 1986

[30] Foreign Application Priority Data

Apr. 8, 1986 [JP] Japan ..... 61-52262

[51] Int. Cl.[4] ..... A24D 5/00; A24D 7/02

[52] U.S. Cl. ..... 131/198.2; 131/198.1; 131/178; 131/187

[58] Field of Search ..... 131/178, 187

[56] References Cited

U.S. PATENT DOCUMENTS 1,816,139 7/1931 Aster ..... 131/198.2
3,265,074 8/1966 Davis ..... 131/198.2
3,289,678 12/1966 Fassbender ..... 131/198.2
4,233,998 11/1980 Radey, Jr. ..... 131/175

*Primary Examiner*—V. Millin
*Attorney, Agent, or Firm*—Young & Thompson

[57] ABSTRACT

A smoking aid for reducing concentrations of poisonous substances contained in tobacco smoke including a pipe bowl having a smoke retaining cavity, a stem coupled with the pipe bowl and a mouthpiece connected to the stem. A cap-like member is movably secured to a top portion of the pipe bowl such that a space formed between the pipe bowl and cap-like member can be adjusted. A hole is formed in a top wall of the cap-like member, through said hole a root portion of a cigarette may be protruded into the smoke retaining cavity. By moving the cap-like member relative to the pipe bowl to adjust a dimension of the space, it is possible to adjust an amount of clean air introduced into the smoke retaining cavity to control a dilution of tobacco smoke.

3 Claims, 8 Drawing Figures

SMOKING AID FOR REDUCING CONCENTRATIONS OF POISONOUS SUBSTANCES CONTAINED IN TOBACCO SMOKE

BACKGROUND OF THE INVENTION

Field of the Invention and Related Art Statement

The present invention relates to a smoking aid for reducing concentration of various poisonous substances contained in tobacco smoke.

Nowadays, it has been recognized that a habit of smoking tobacco, particularly cigarettes might be hazardous for the health, because tobacco smoke contains various poisonous substances such as coal-tar and nicotine. In order to decrease concentrations of these poisonous substances contained in the tobacco smoke it had become general that a filter is provided integrally with a cigarette. There have been proposed various kinds of filters in order to absorb the poisonous substances contained in the tobacco smoke in an effective manner. However, such filters could not effectively reduce the concentrations of hazardous substances contained in the tobacco smoke, mainly due to the fact that the filters could not have a sufficient length.

In order to remove more effectively the poisonous substances from the tobacco smoke, there has been further proposed a smoking pipe in the form of a cigarette holder comprising a tubular main body with a mouthpiece at one end and a cigarette holding cavity at the other end and a filter element detachably mounted in the tubular main body. In such a known smoking aid, tobacco smoke is passed through the filter element in the pipe, and the poisonous substances in the smoke are removed by the filter element. However, in such a pipe, it is impossible to adjust an amount of smoke introduced into a smoker, and therefore, the known pipe could not promote the effect of reducing the number of cigarettes smoked by a day. That is to say, when a smoker who is used to smoking twenty cigarettes a day uses the known pipe, it is only possible to reduce the concentrations of poisonous substances contained in tobacco smoke, but it is impossible to reduce the number of cigarettes a day.

SUMMARY OF THE INVENTION

The present invention has for its object to provide a novel and useful smoking aid by means of which concentrations of poisonous substances contained in tobacco smoke can be effectively reduced and at the same time a concentration of the tobacco smoke can be adjusted over a wide range by introducing an adjustable amount of clean air into the tobacco smoke, so that a smoker can be effectively protected against the poisonous substances and the number of cigarettes a day can be naturally decreased without an extraordinary effort of the smoker.

According to the invention, a smoking aid for reducing concentrations of poisonous substances contained in tobacco smoke comprises a main portion for defining a smoke retaining cavity;

a stem portion having a conduit communicated with said smoke retaining cavity;

a mouthpiece portion communicated with said conduit of said stem portion; and a cap-like member movably secured to said main portion such that a space communicated with said smoke retaining cavity is formed between said main portion and cap-like member, and having a hole through which a root portion of a cigarette is protruded into said smoke retaining cavity; whereby an amount of clean air introduced into said smoke retaining cavity through said space is adjustable by moving the cap-like member relative to said main portion.

DESCRIPTION OF THE PREFERRED EMBODIMENTS

Figure 1A:
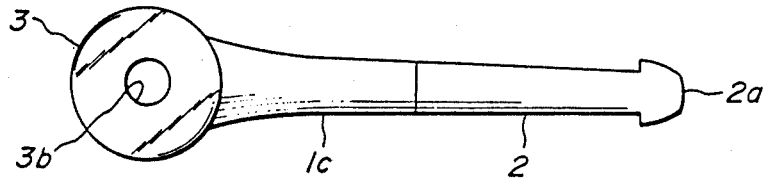
FIGS. 1A and 1B show an embodiment of the smoking aid according to the invention.
Figure 1B:
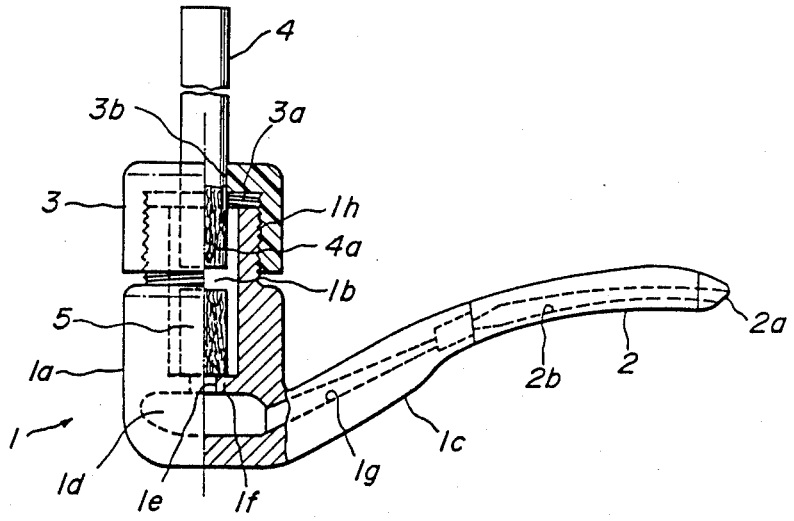

FIGS. 1A and 1B illustrate a first embodiment of the smoking aid according to the invention. In the present embodiment, the smoking aid is constituted in the shape of a tobacco pipe. The pipe comprises a main body 1 including a pipe bowl 1*a* within which a smoke retaining cavity 1*b* is formed, and a stem portion 1*c*. At a lower portion of the pipe bowl 1*a* there is formed a caity 1*d* which is communicated with the smoke retaining cavity 1*b* via a hole 1*e* formed in a partition 1*f*. To the stem portion 1*c* is detachably secured a mouthpiece portion 2 having a mouthpiece 2*a* and a conduit 2*b* which is communicated with the cavity 2*d* via a conduit 1*g* formed in the stem portion 1*c*.

In an outer surface of an upper portion of the pipe bowl 1*a* is formed a male screw 1*h* which is engaged with a female screw 3*a* formed in an inner side wall of a cap-like member 3. In a top wall of the cap-like member 3 there is further formed a hole 3*b* having a diameter which is equal to or slightly larger than a diameter of a cigarette 4. Therefore, a root portion of the cigarette 4 can be firmly inserted into the hole 3*b* to such an extent that the root portion extrudes into an inside space of the cap-like member 3 as illustrated in FIG. 1B. The main body 1 of the pipe is made of wood, the mouthpiece stem 2 is made of synthetic resin or metal, and the cap-like member 3 is made of synthetic resin.

According to the invention, the smoke retaining cavity 1*b* has such a dimension that a filter 5 is inserted therein as shown in FIG. 1*b*. After the root portion of the cigarette 4 is inserted into the hole 3*b* of the cap-like member 3, a top end of the cigarette is lighted up, while air is sucked through the mouthpiece 2*a*. Then tobacco smoke is first introduced into the smoke retaining cavity 1*b* and further flows through the filter 5, cavity 1*d*, conduits 1*g* and 2*b*. In this case, since there is a space between the male screw 1*h* and the female screw 3*a*, a clean air is introduced into the smoke retaining cavity 1*b*. It is matter of course that an amount of the air introduced into the smoke retaining cavity 1*b* through the space between the screws 1*h* and 3*a* can be adjusted over a wide range by turning the cap-like member 3 relative to the main body 1. That is to say, when the cap-like member 3 is gradually clamped to the main body 1, the space between the screws 1*h* and 3*a* becomes narrower and an amount of the air sucked through the space becomes gradually decreased. At last when the cap-like member 3 is firmly or tightly coupled with the main body 1, the space between the screws 1*h* and 3*a* is closed and the air is not introduced into the cavity 1*b*. In this manner, by turning the cap-like member 3 relative to the main body 1, it is possible to adjust an amount of the clean air introduced into the cavity 1*b* through the space between the main body 1 and the cap-like member 3. When the air is introduced into the smoke retaining cavity 1*b*, the smoke which is also introduced into the cavity 1*b* is mixed and diluted with the air. In this manner, a concentration of the smoke can be effectively reduced. Further, the smoke having the concentration reduced by the air is passed through the filter 5, it is possible to reduce concentrations of poisonous substances contained in the tobacco smoke to unharmful level.

In the smoking aid according to the invention, when the cap-like member 3 is loosely coupled with the top portion of the pipe bowl 1*a* and an amount of the air introduced into the smoke retaining cavity 1*b* through the space between the screws 1*h* and 3*a* is increased, a total amount of smoke gas sucked by the user is large, but an amount of tobacco smoke can be reduced materially. Therefore, a burning rate of the cigarette becomes smaller, so that a smoker can smoke the single cigarette for a longer time period. Further, the diluted smoke is passed through the filter 5, the poisonous substances in the smoke can be effectively reduced. Due to the above mentioned functions, when the smoker uses the pipe according to the invention, the smoker may have a feeling that he has smoked twenty cigarettes a day, even if he actually smokes only fifteen cigarettes. In this manner, the number of cigarettes a day can be naturally decreased without an extraordinary effort of the smoker. It should be noted that if the cigarette 4 itself has a filter element 4*a* as depicted in FIG. 1B, the tobacco smoke is passed through the two filters 4*a* and 5, and thus the hazardous substances in the tobacco smoke can be effectively reduced. According to the invention, the filter 5 placed in the smoke retaining cavity 1b may be the filter element 4*a* provided in the root portion of the cigarette 4. In this case, after the cigarette 4 has been smoked, the filter element 4*a* is removed from the cigarette 4 and the filter element 4*a* thus removed is inserted into the smoke retaining cavity 1*b* instead of the previous filter 5. In this manner, the filter 5 may be simply renewed every time a cigarette is smoked. Of course, it is also possible to prepare specific filters and replace a used filter by a new one occasionally.

Figure 2:
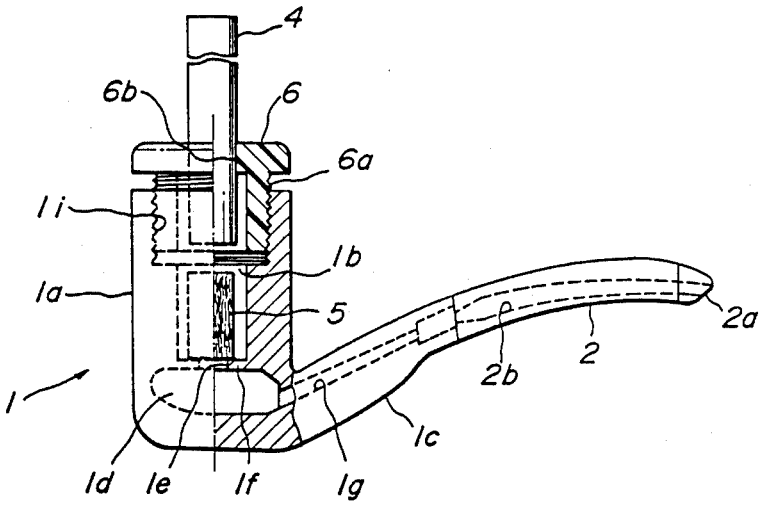
FIG. 2 is a side view of another embodiment of the smoking aid according to the invention.

FIG. 2 shows another embodiment of the smoking aid according to the invention. In the present embodiment portions similar to those shown in FIG. 1B are denoted by the same reference numerals used in FIG. 1B and an explanation thereof is omitted. In the present embodiment, on an inner wall of an upper portion of the pipe bowl 1*a* there is formed a female screw 1*i* which is engaged with a male screw 6*a* formed in an outer surface of a side wall of a cap-like member 6. The cap-like member 6 has a hole 6*b* formed in a top wall thereof, through which the root portion of the cigarette 4 is protruded into the smoke retaining cavity 1*b* of the pipe bowl 1*a*. The other construction of the pipe of the present embodiment is entirely same as that of the embodiment shown in FIGS. 1A and 1B.

Figure 3A:
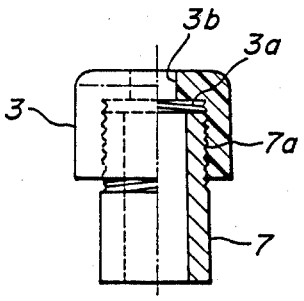
FIGS. 3A and 3B are side views illustrating another embodiment of the smoking aid according to the invention.
Figure 3B:
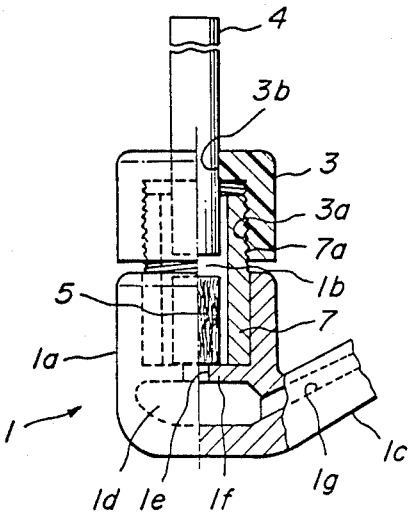

FIGS. 3A and 3B illustrate still another embodiment of the smoking acid according to the invention. Also in the present embodiment, the smoking aid is constructed in the form of the pipe. In this embodiment, a sleeve 7 made of synthetic resin is firmly inserted into the smoke retaining cavity 1*b* of the pipe bowl 1*a*. In an outer surface of an upper portion of the sleeve 7 is formed a male screw 7*a* which is engaged with the female screw 3*a* of the cap-like member 3. Also in the present embodiment, an amount of the air sucked into the smoke retaining cavity 1*b* can be adjusted by turning the cap-like member 3 relative to the main body 1, so that the tobacco smoke can be diluted at will over a wide range. It should be also noted that the diluted tobacco smoke is passed through the filter 5 and any hazardous substances contained in the tobacco smoke can be effectively removed by the filter 5.

In the embodiment shown in FIG. 3A, the tubular sleeve 7 is inserted into the smoke retaining cavity 1*b* to such an extent that a lower end of the sleeve is urged against the partition 1*f*. In a modified embodiment, the partition may be integrally formed with the sleeve 7. In such a case, it is possible to use a usual pipe bowl having no partition.

Figure 4:
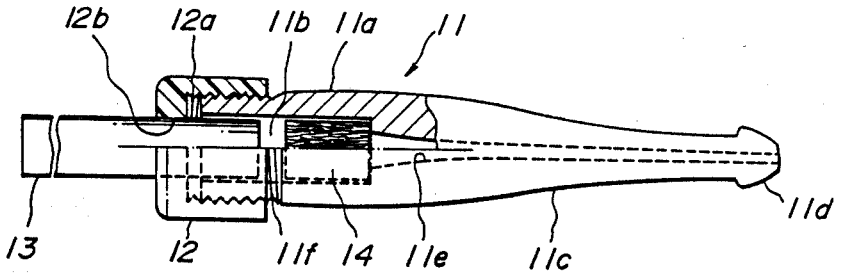
FIG. 4 is a side view depicting another embodiment of the smoking aid according to the invention.

FIG. 4 illustrates another embodiment of the smoking aid according to the invention. In the present embodiment, the smoking aid is constructed in the form of the cigarette holder. The cigarette holder comprises a main body 11 having a head portion 11*a* in which a smoke retaining cavity 11*b* is formed, a stem portion 11*c* and a mouthpiece 11*d*. The main body 11 may be made of synthetic resin, wood or metal. The smoke retaining cavity 11*b* is communicated with the mouthpiece 11*d* via a conduit 11*e*. In an outer surface of the head portion 11*a* of the main body 11 is formed a male screw 11*f* which is engaged with a female screw 12*a* formed on an inner side wall of a cap-like member 12 made of synthetic resin. In an upper wall of the cap-like member 12, there is formed a hole 12*b* through which a root portion of a cigarette 13 is protruded into the smoke retaining cavity 11*b* of the head portion 11*a*. In the smoke retaining cavity 11*b* a filter 14 is detachably inserted. In the present embodiment, an amount of the air sucked into the smoke retaining cavity 11*b* through a space between the male screw 11*f* of the head portion 11*a* and the female screw 12*a* of the cap-like member 12 can be adjusted by turning the cap-like member 12 relative to the head portion 11*a* of the main body 11. In this manner, tobacco smoke is mixed with the clean air and is diluted therewith in the smoke retaining cavity 11*b*. Then the diluted tobacco smoke is passed through the filter 14, so that concentrations of poisonous substances contained in the tobacco smoke can be materially reduced in an effective manner.

Figure 5:
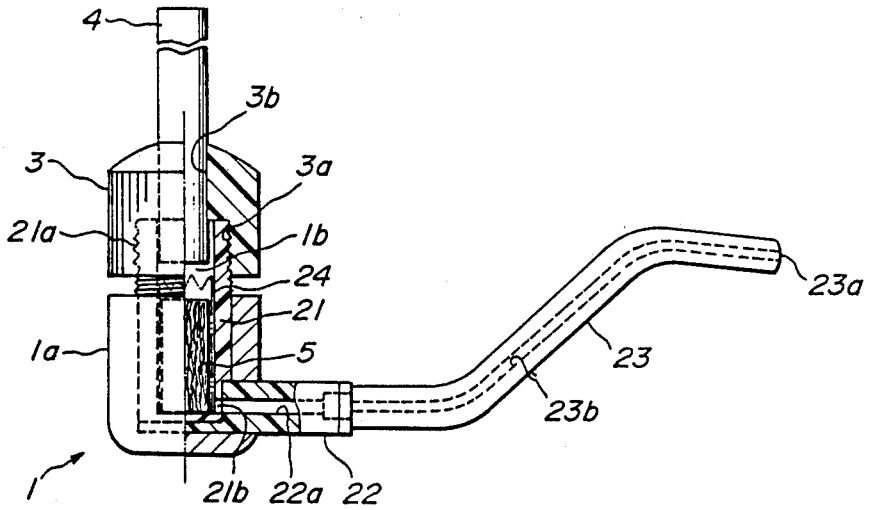
FIG. 5 is a side view showing still another embodiment of the smoking aid according to the invention.

FIG. 5 shows a still another embodiment of the smoking aid according to the invention. In the present embodiment, portions similar to those shown in FIG. 1B are denoted by the same reference numerals used in FIG. 1B and their explanation is omitted. In the present embodiment, the smoking aid is shaped in the form of the pipe. The pipe comprises a main body 1 made of wood or corncob and having a pipe bowl 1*a* within which a smoke retaining cavity 1*b* is formed. In the smoke retaining cavity 1*b* of the pipe bowl 1*a* is inserted a cup-like member 21 made of synthetic resin. In an outer surface of an upper portion of the cup-like member 21 is formed a male screw 21*a* which is engaged with a female screw 3*a* formed on an inner side wall of a cap-like member 3 made of synthetic resin. In a top wall of the cap-like member 3 is formed a hole 3*b* through which a root portion of a cigarette 4 is protruded into the smoke retaining cavity 1b. In the smoke retaining cavity 1b, a filter 5 is detachably inserted. At a lower end of the cup-like member 21 there is formed a small hole 21b which is communicated with a conduit 22a of a fitting tube 22 made of synthetic resin. The fitting tube 22 may be secured both to the cup-like member 21 and the pipe bowl 1a with the aid of a suitable bonding agent. To a free end of the fitting tube 22 is detachably secured a pipe stem 23 having a mouthpiece 23a communicated with the conduit 22a of the fitting tube 22 via a conduit 23b.

Also in the present embodiment, an amount of the clean air sucked into the smoke retaining cavity 1b through a space between the screws 3a and 21a can be adjusted at will by turning the cap-like member 3 relative to the pipe bowl 1a.

Figure 6:
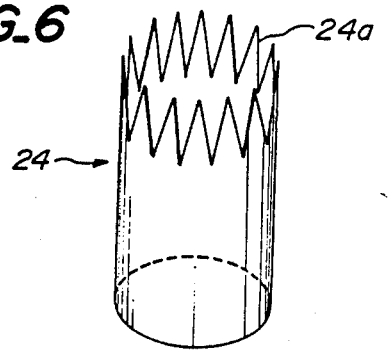
FIG. 6 is a perspective view illustrating a sleeve member inserted in the smoking aid shown in FIG. 5.

In the present embodiment, the filter 5 may be inserted into a sleeve member 24 made of paper or tin foil. As shown in FIG. 6, a top portion of the sleeve member 24 is cut into a crenelated shape. Each triangular projections 24a of the sleeve member 24 may be bent inwardly when the cap-like member 3 is moved downward relative to the pipe bowl 1a so that a lower end surface of the cigarette 4 presses the projections 24a. Then an amount of the diluted tobacco smoke sucked via the mouthpiece 23a is reduced greatly, because a great part of an upper end surface of the filter 5 is closed by the bent projections 24a of the sleeve member 24.

The present invention is not limited to the embodiments explained above, but many modifications and alternations may be conceived within the scope of the invention. For instance, in the above embodiments, the cap-like member is detachably connected to the upper portion of the main body of the pipe or cigarette holder by means of the screw engagement. However, the cap-like member may be movably coupled with the main portion by means of various coupling mechanisms. Further, the filter is not always necessary to be inserted in the smoke retaining cavity.

In the smoking aid according to the invention, it is possible to adjust an amount of the clean air introduced into the smoke retaining cavity by moving the cap-like member relative to the main body in which the smoke retaining cavity is formed, and thus a concentration of the tobacco smoke can be adjusted at will. Therefore, concentrations of poisonous substances contained in the tobacco smoke can be reduced. For instance, when an amount of the clean air introduced into the smoke retaining cavity is made large, an amount of the air passing through the cigarette is reduced, so that a burning rate of the cigarette is also decreased and the smoker can smoke the cigarette for a longer time period. In this manner, the number of cigarettes a day can be naturally reduced without a great effort.

What is claimed is:

1. A smoking aid for reducing concentrations of poisonous substances contained in tobacco smoke comprising:

a main portion for defining a smoke retaining cavity;

a stem portion having a conduit communicated with said smoke retaining cavity;

a mouthpiece portion communicated with said conduit of said stem portion; and a cap-like member movably secured to said main portion such that a space communicated with said smoke retaining cavity is formed between said main portion and cap-like member, and having a hole through which a root portion of a cigarette is protruded into said smoke retaining cavity; whereby an amount of clean air introduced into said smoke retaining cavity through said space is adjustable by moving the cap-like member relative to said main portion, and a filter detachably inserted in said smoke retaining cavity, said main portion comprising a screw and said cap-like member comprises a screw which is engaged with said screw of the main portion, whereby said space is formed between said screws, said main portion comprising a pipe bowl and a sleeve inserted into said pipe bowl, and said screw of the main portion is formed in an outer surface of the sleeve.

2. A smoking aid for reducing concentrations of poisonous substances contained in tobacco smoke comprising:

a main portion for defining a smoke retaining cavity;

a stem portion having a conduit communicated with said smoke retaining cavity;

a mouthpiece portion communicated with said conduit of said stem portion; and a cap-like member movably secured to said main portion such that a space communicated with said smoke retaining cavity is formed between said main portion and cap-like member, and having a hole through which a root portion of a cigarette is protruded into said smoke retaining cavity; whereby an amount of clean air introduced into said smoke retaining cavity through said space is adjustable by moving the cap-like member relative to said main portion, and a filter detachably inserted in said smoke retaining cavity, said main portion comprising a screw and said cap-like member comprises a screw which is engaged with said screw of the main portion, whereby said space is formed between said screws, said main portion comprising a pipe bowl and a cup-like member inserted in the pipe bowl, and said screw of the main portion is formed in an outer surface of the cup-like member.

3. A smoking aid for reducing concentrations of poisonous substances contained in tobacco smoke comprising:

a main portion for defining a smoke retaining cavity;

a stem portion having a conduit communicated with said smoke retaining cavity;

a mouthpiece portion communicated with said conduit of said stem portion; and a cap-like member movably secured to said main portion such that a space communicated with said smoke retaining cavity is formed between said main portion and cap-like member, and having a hole through which a root portion of a cigarette is protruded into said smoke retaining cavity; whereby an amount of clean air introduced into said smoke retaining cavity through said space is adjustable by moving the cap-like member relative to said main portion, and a filter detachably inserted in said smoke retaining cavity, said main portion comprising a screw and said cap-like member comprises a screw which is engaged with said screw of the main portion, whereby said space is formed between said screws, and a sleeve member made of paper and having a crenelated upper edge, whereby said filter is inserted in the sleeve member.

* * * * *